US008052235B2

(12) United States Patent
Kelly et al.

(10) Patent No.: US 8,052,235 B2
(45) Date of Patent: Nov. 8, 2011

(54) STORAGE COMPARTMENT

(75) Inventors: Paul H. Kelly, Anderson, SC (US); Aaron W. Arvia, Anderson, SC (US); Edmund Scott Richardson, Simpsonville, SC (US); Kenneth L. Pope, Piedmont, SC (US); Richard B. Moulder, Anderson, SC (US); David A. Simoni, Piedmont, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 355 days.

(21) Appl. No.: 11/758,843

(22) Filed: Jun. 6, 2007

(65) Prior Publication Data

US 2008/0302441 A1 Dec. 11, 2008

(51) Int. Cl.
*A47B 96/04* (2006.01)

(52) U.S. Cl. ..... 312/404; 312/333; 312/296; 312/319.5; 292/201

(58) Field of Classification Search ..... 312/402, 312/404, 330.1, 333, 296, 319.5–319.8, 334.7–334.12, 312/349; 292/201, DIG. 69
See application file for complete search history.

(56) References Cited

U.S. PATENT DOCUMENTS

| | | | | |
|---|---|---|---|---|
| 2,425,816 | A | 8/1947 | Maxson | |
| 2,894,845 | A * | 7/1959 | Stoddard | 426/419 |
| 3,216,214 | A | 11/1965 | Gasbarro | |
| 3,217,921 | A * | 11/1965 | Frehse | 220/378 |
| 4,615,178 | A | 10/1986 | Badenhop | |
| 4,829,653 | A * | 5/1989 | Stich | 29/458 |
| 5,040,856 | A * | 8/1991 | Wilkins et al. | 312/402 |
| 5,046,332 | A | 9/1991 | Herrmann et al. | |
| 5,095,717 | A | 3/1992 | Germi | |
| 5,136,853 | A | 8/1992 | Girardon et al. | |
| 5,157,940 | A * | 10/1992 | Bertu et al. | 62/382 |
| 5,271,240 | A | 12/1993 | Detrick et al. | |
| 5,551,775 | A * | 9/1996 | Parvin | 312/334.11 |

(Continued)

FOREIGN PATENT DOCUMENTS

CN 1910417 2/2007

(Continued)

OTHER PUBLICATIONS

Chinese Office Action dated Dec. 27, 2010 for Chinese patent application for 200880022917.4.

*Primary Examiner* — Janet M Wilkens
*Assistant Examiner* — Daniel Rohrhoff
(74) *Attorney, Agent, or Firm* — Pearne & Gordon LLP

(57) ABSTRACT

A storage compartment comprises an external enclosure having an opening and a holding compartment that is capable of being inserted into and withdrawn from the interior of the external enclosure through the opening in the external enclosure. Stored articles are contained within the holding compartment. The external enclosure and the holding compartment have coacting surfaces, and a seal is interposed between those coacting surfaces for sealing off the interior of the holding compartment to the entry of gases when the holding compartment is inserted into the external enclosure and the coacting surfaces of the external enclosure and the holding compartment are brought together in a sealing relationship with the seal. Complementary surfaces at the holding compartment and at the exterior of the external enclosure are in engagement with one another and provide surfaces along which the holding compartment travels when it is inserted into and withdrawn from the interior of the external enclosure.

32 Claims, 6 Drawing Sheets

U.S. PATENT DOCUMENTS

| | | | | |
|---|---|---|---|---|
| 5,946,919 | A | 9/1999 | McKinney et al. | |
| 6,090,422 | A | 7/2000 | Taragan et al. | |
| 6,148,875 | A * | 11/2000 | Breen | 141/65 |
| 6,166,353 | A * | 12/2000 | Senneville et al. | 219/385 |
| 6,170,276 | B1 * | 1/2001 | Mandel et al. | 62/187 |
| 6,315,336 | B1 * | 11/2001 | Swartzell | 292/201 |
| 6,511,138 | B1 | 1/2003 | Gardner et al. | |
| 6,598,517 | B1 | 7/2003 | McCausland | |
| 6,612,116 | B2 * | 9/2003 | Fu et al. | 62/3.6 |
| 6,834,922 | B2 * | 12/2004 | Cho | 312/331 |
| 6,971,418 | B2 | 12/2005 | De Costa | |
| 7,012,229 | B2 | 3/2006 | Kim | |
| 7,156,428 | B2 * | 1/2007 | Smith | 292/201 |
| 7,161,125 | B2 * | 1/2007 | Yoshidome et al. | 219/756 |
| 7,325,409 | B2 * | 2/2008 | Espinosa | 62/78 |
| 7,334,823 | B2 * | 2/2008 | Courter et al. | 292/201 |
| 7,387,351 | B2 * | 6/2008 | Nam | 312/402 |
| 2002/0083724 | A1 | 7/2002 | Tarlow et al. | |
| 2004/0051427 | A1 * | 3/2004 | Cittadini et al. | 312/296 |
| 2006/0001274 | A1 * | 1/2006 | Smith | 292/204 |
| 2006/0010890 | A1 | 1/2006 | Feinauer et al. | |
| 2006/0090427 | A1 | 5/2006 | Hau et al. | |
| 2008/0148765 | A1 * | 6/2008 | Barone et al. | 62/407 |
| 2008/0302114 | A1 * | 12/2008 | Kelly et al. | 62/170 |

FOREIGN PATENT DOCUMENTS

| | | | |
|---|---|---|---|
| WO | 0171263 | A1 | 9/2001 |
| WO | 2005114070 | A1 | 1/2005 |
| WO | 2005114071 | A1 | 1/2005 |
| WO | 2005057103 | A1 | 6/2005 |

* cited by examiner

FIG. 4
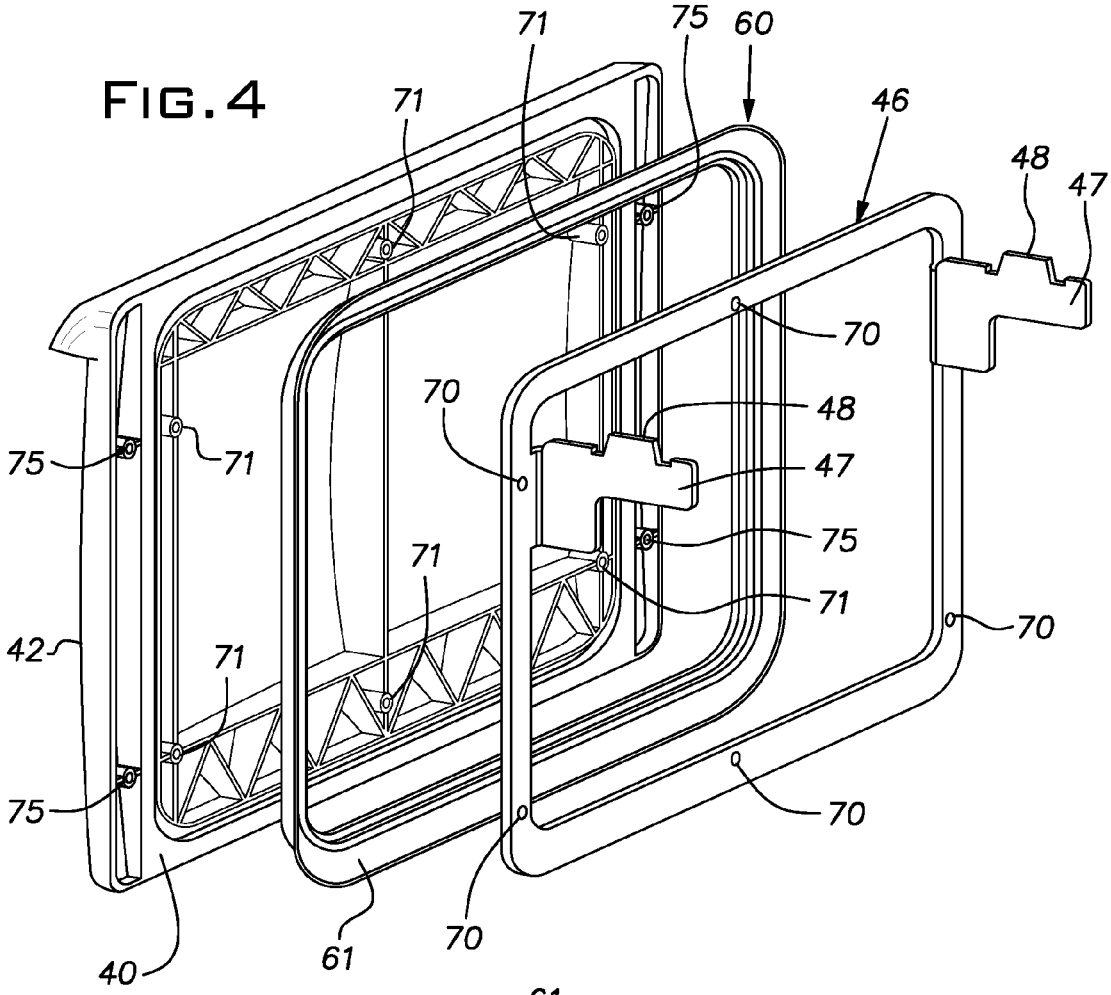
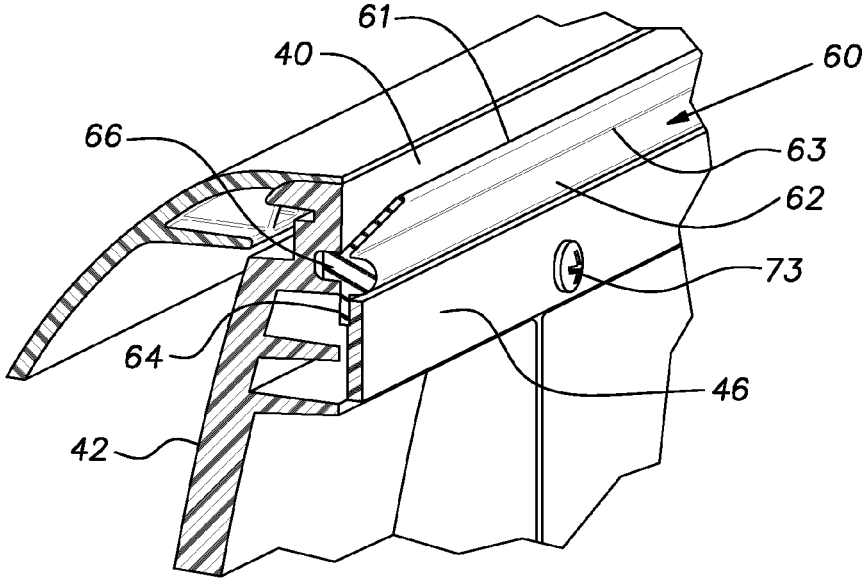
FIG. 5

STORAGE COMPARTMENT

BACKGROUND OF THE INVENTION

The present invention generally concerns storage compartments or units for storing articles and in particular the invention relates to storage compartments for refrigeration appliances such as household refrigerators.

The storage of articles in a storage compartment having a controlled environment is known. For example, storage compartments can be provided the interiors of which are capable of being isolated from the ambient air and from which gases such as oxygen can be removed. Perishable foodstuffs kept in such storage compartments will remain fresher for longer periods of time and the deterioration of the foodstuffs delayed. The maintenance of foodstuffs in this manner can be enhanced where the storage unit is located in a refrigeration appliance such as a household refrigerator.

Foodstuffs that are stored in storage compartments from which gases have been removed and that are maintained isolated from the ambient surroundings are sometimes said to be kept under vacuum. That is not to imply that all or even substantially all of the gases will have been evacuated from the storage compartments where the foodstuffs are maintained. The extent to which gases are evacuated from the storage compartments is largely a matter of choice and depends to a great extent on the capability of the device, such as a pump, that is used to evacuate the gases.

Examples of storage systems, including storage compartments of the type described above, are disclosed in U.S. patent application Ser. No. 11/758,141, filed on Jun. 5, 2007 and entitled "Storage Systems" which application is hereby incorporated herein by reference.

SUMMARY OF THE INVENTION

According to one aspect of the invention, a storage compartment comprises an external enclosure having an opening by means of which access may be had to the interior of the enclosure and a holding compartment that is capable of being inserted into and withdrawn from the interior of the external enclosure through the opening in the external enclosure. The external enclosure and the holding compartment have coacting surfaces, and a seal is interposed between those coacting surfaces for sealing off the interior of the holding compartment to the entry of gases from outside the holding compartment. The holding compartment is adapted to be in gas flow communication with a gas evacuation system for removing gases from the interior of the holding compartment. Complementary surfaces at the holding compartment and at the exterior of the external enclosure are in engagement with one another and provide the surfaces along which the holding compartment travels when it is inserted into and when it is withdrawn from the interior of the external enclosure.

According to yet another aspect, the holding compartment can include a front panel that includes the coacting surface of the holding compartment and a pan for holding articles placed within the holding compartment. A forward end of the pan can be supported at the front panel and a rearward end of the pan can be supported at the interior of the external enclosure. In this aspect, the seal can be mounted at the coacting surface at the front panel. Additionally, a bracket can be mounted at the front panel for securing the seal in place at the coacting surface at the front panel and providing a support system for supporting the forward end of the pan.

According to yet a further aspect, a seal can be interposed between a coacting surface of a first component of a storage compartment and a coacting surface of a second component of the storage compartment. The first and second components of the storage compartment are movable with relation to one another and are adapted to be moved together into a sealing relationship together with the seal. The seal can include a first portion and a second portion. The first portion and the second portion of the seal can be arranged with respect to one another such that the first portion of the seal comes into contact with the one of the coacting surfaces of the first and second components of the storage compartment at which the seal is not mounted before the second portion of the seal comes into contact with the one of the coacting surfaces of the first and second components at which the seal is not mounted when the first component is inserted into the interior of the second component and the coacting surfaces of the first component and the second component are brought together in a sealing relationship with the seal. In that case, the first portion of the seal is more flexible than the second portion of the seal, whereby, as the coacting surfaces of the first and second components are brought together in a sealing relationship, the first portion of the seal forms an initial seal between the coacting surfaces of the first and second components. The second portion of the seal forms a more substantial additional seal between the coacting surfaces of the first and second components as the coacting surfaces of the first and second components are brought closer together.

According to still a further aspect, a latching mechanism is provided for securing together a first component and a second component of a storage compartment, such as the external enclosure and holding compartment of the storage compartment. The latching mechanism can comprise a fixed retaining element mounted at one of the first component and the second component and a movable latching element mounted at the other one of the first component and the second component. The movable latching element comprises a hook-shaped element in which is located an opening, the hook-shaped element being movable between a position where the hook-shaped element is free of the fixed retaining element and a position where the hook-shaped element is latched to the fixed retaining element. A driving arrangement is operatively associated with the hook-shaped element for moving the hook-shaped element between these two positions. The driving arrangement can include a motor with a drive shaft attached to a cam located in the opening in the hook-shaped element so as to rotate the cam within the opening in the hook-shaped element and cause the hook-shaped element to move between the two positions. A fixed pin can be located in a guide slot in the hook-shaped element, the guide slot having a configuration such that the fixed pin and the guide slot cooperatively assist in causing the hook-shaped element to move between the two positions. A flange can be attached to the cam so as to rotate with the cam, the flange having two contact points, one contact point adapted to contact a control switch when the hook-shaped element is in the position free of the fixed retaining element and the other contact point adapted to contact the control switch when the hook-shaped element is latched to the fixed retaining element.

With all of the foregoing aspects and embodiments, the storage compartment can be located in the interior of a refrigeration appliance such as the fresh food compartment of a household refrigerator.

BRIEF DESCRIPTION OF THE DRAWINGS

FIG. 4 is an exploded perspective view of the front portion of the holding compartment of the embodiment of the storage compartment shown in FIG. 2.

FIG. 5 is a partial perspective view, partly in cross-section, of the front portion of the holding compartment of the embodiment of the storage compartment shown in FIG. 2.

DETAILED DESCRIPTION OF THE INVENTION

Figure 1:
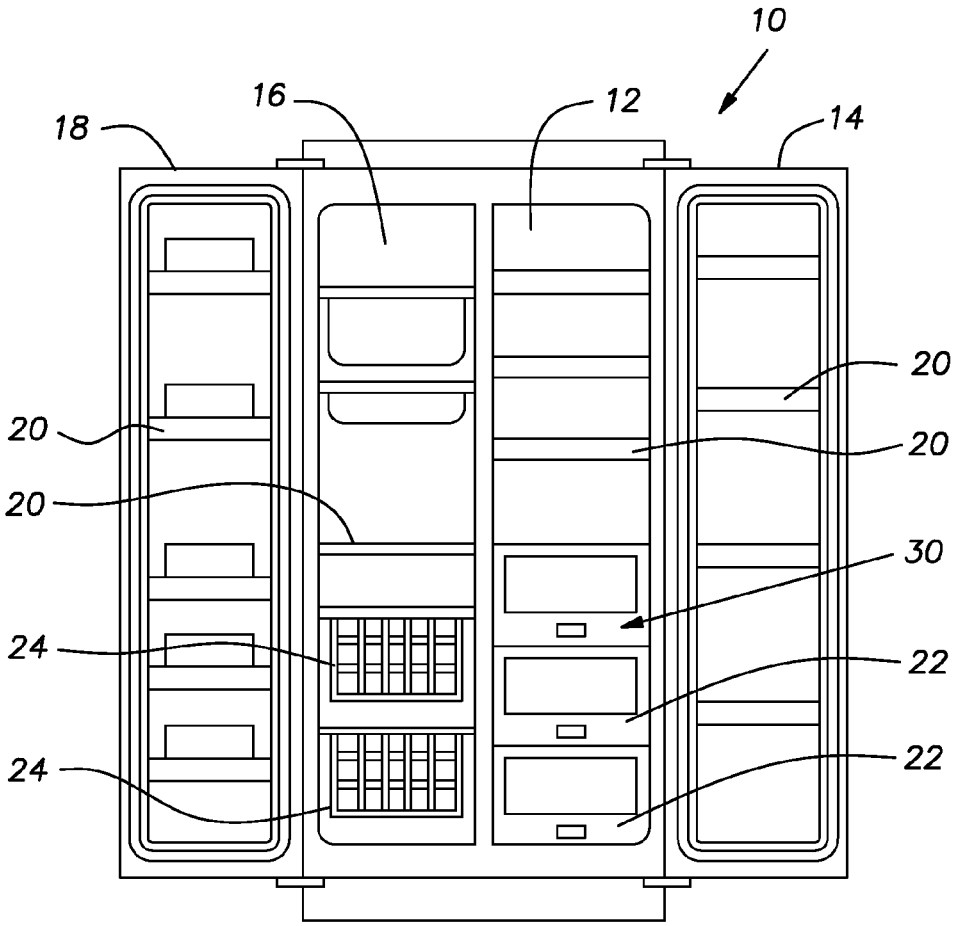
FIG. 1 is a front elevational view of a household refrigerator incorporating an embodiment of the storage compartment of the present invention, the doors of the refrigerator being shown as open for the purpose of illustrating the interior of the refrigerator.

Referring to the drawings, FIG. 1 shows a typical household refrigerator, indicated generally at 10, comprising a fresh food compartment 12 and a freezer compartment 16. A door 14, shown in FIG. 1 as open, is mounted to the refrigerator body by hinges and serves to close the front of the fresh food compartment 12 as well as provide access to the interior of the fresh food compartment. A door 18, shown in FIG. 1 as open, also is mounted to the refrigerator body by hinges and serves to close the front of the freezer compartment 16 as well as provide access to the interior of the freezer compartment. The fresh food and freezer compartments can include a variety of shelves 20, closed drawers 22 and basket-like drawers 24 for storing articles of food and the like.

The refrigerator 10 also incorporates in the fresh food compartment 12 an embodiment 30 of the storage compartment of the invention. Although the storage compartment 30 of the invention is shown and described herein with reference to the incorporation of the storage compartment in the fresh food compartment of a household refrigerator, the compartment can be used in other circumstances such as, for example, in other types of refrigeration appliances and in other types of controlled environments, such as in the freezer compartment of a refrigerator. Or the storage compartment can be used as a self-contained storage compartment outside a controlled environment. For example, the storage compartment of the invention can be located in a household kitchen cabinet. Additionally, the storage compartment 30 can be located at virtually any location in the fresh food compartment and more than one storage compartment can be provided.

The embodiment of the storage compartment of the invention shown in the drawings can have at least two modes of operation as described in more detail in U.S. patent application Ser. No. 11/758,141 referred to above. As indicated in that application, in a first mode of operation, gases are evacuated from the storage compartment while the compartment is sealed from the admittance of gases from the exterior of the compartment, whereby the articles being stored in the compartment are stored at a pressure less than the pressure at the exterior of the storage compartment. Articles stored in this manner are sometimes said to be stored under vacuum. It will be understood that when the pressure in the storage compartment is less than the pressure at the exterior of the compartment, less oxygen will be present in the compartment so that any deleterious effect of the oxygen on articles stored in the compartment will be mitigated.

In a second mode of operation, gases are evacuated from the storage compartment while the compartment is open to the admittance of gases from the exterior of the compartment, whereby the articles being stored are ventilated by the gases admitted to the storage compartment. Typically, the gases admitted will comprise the ambient air. This arrangement is of advantage when the storage compartment is being used as a crisper in a refrigerator fresh food compartment. The storage compartment can also have a third mode of operation wherein both the first mode of operation and the second mode of operation are rendered inoperative.

The embodiment of the storage compartment shown in the accompanying drawings can function so that when the articles are stored in the first mode of operation, the storage compartment is operative to intermittently remove additional gases from the compartment, whereby the pressure at which the articles are being stored is maintained at less than the pressure at the exterior of the compartment. The removal of additional gases may be required for example because of the infiltration into the storage compartment of the gases or the generation of gases by the articles stored in the storage compartment.

Figure 2:
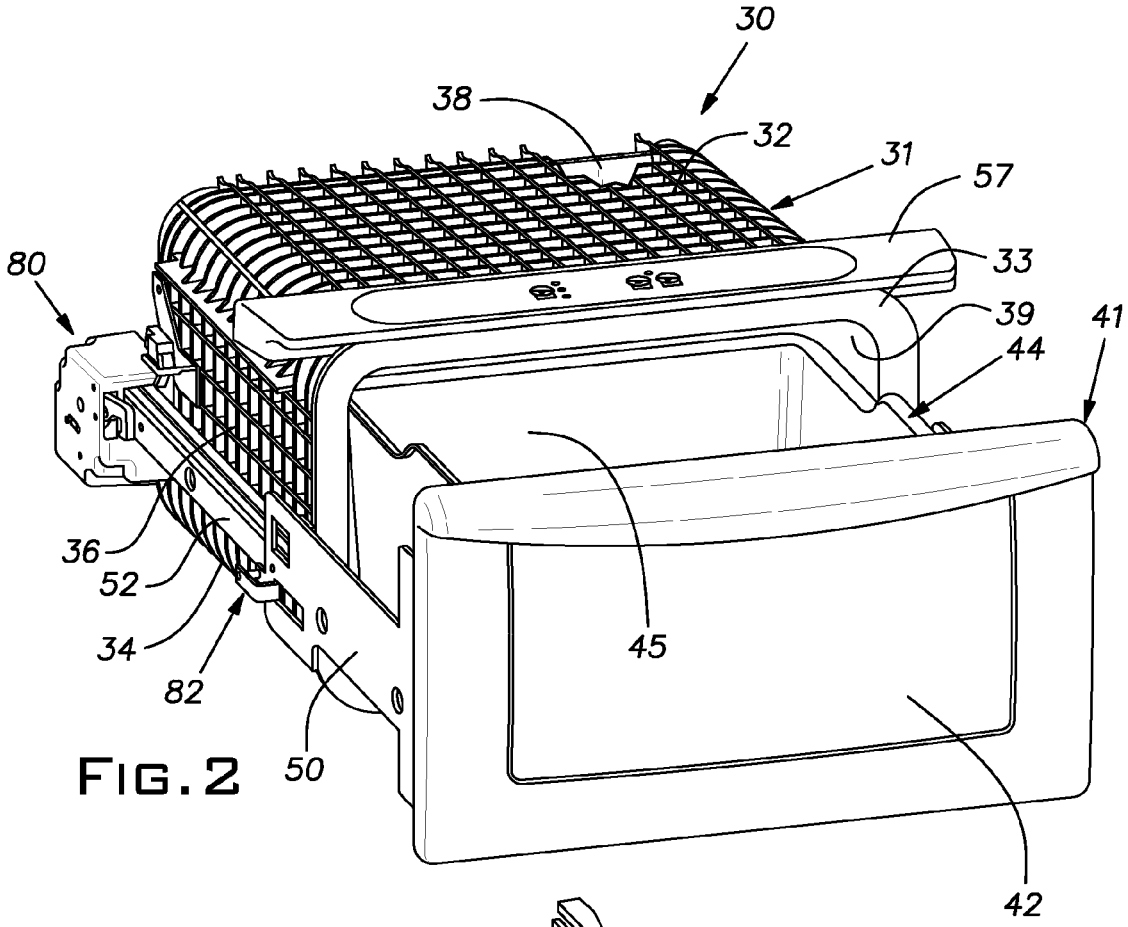
FIG. 2 is a perspective view of an embodiment of the storage compartment of the invention illustrated with the holding compartment of the storage compartment substantially withdrawn from the interior of the external enclosure of the storage compartment.
Figure 3:
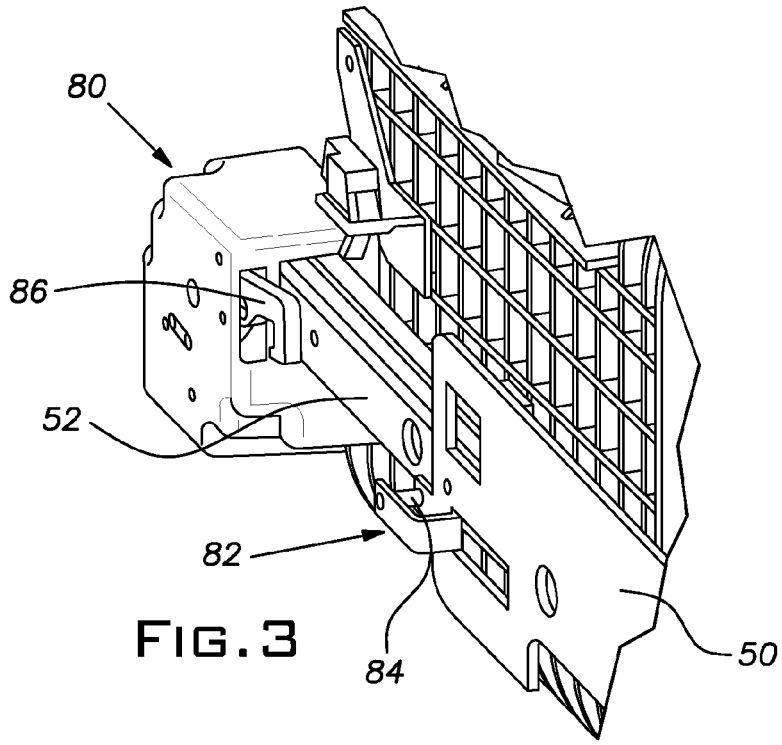
FIG. 3 is a partial perspective view of an embodiment of the latching mechanism, comprising a fixed latching element and a movable latching element, that can be used to secure together the holding compartment and the external enclosure of the storage compartment.

One embodiment of the storage compartment 30 of the invention is shown in greater detail in FIG. 2. In that figure the storage compartment is shown as removed from the refrigerator 10 but is adapted to be contained within a refrigerator. The storage compartment, when contained within the fresh food compartment of a refrigerator, can be secured to the interior of the fresh food compartment in any convenient manner familiar to those having ordinary skill in the art.

The storage compartment 30 is shown in FIG. 2 as open whereby access can be had to the interior of the compartment for the purpose, for example, of placing into or removing from the interior of the storage compartment articles stored in the compartment. In this connection, the storage compartment 30 comprises an external enclosure or housing, indicated generally at 31, and a holding compartment, in the general form of a drawer in the illustrated embodiment and indicated generally at 41, that is adapted to be in gas flow communication with a gas evacuation system further described below for removing gases from the interior of the holding compartment 41. The enclosure 31 is referred to as an external enclosure in the sense that the enclosure 31 is external to the holding compartment 41.

Figure 11:
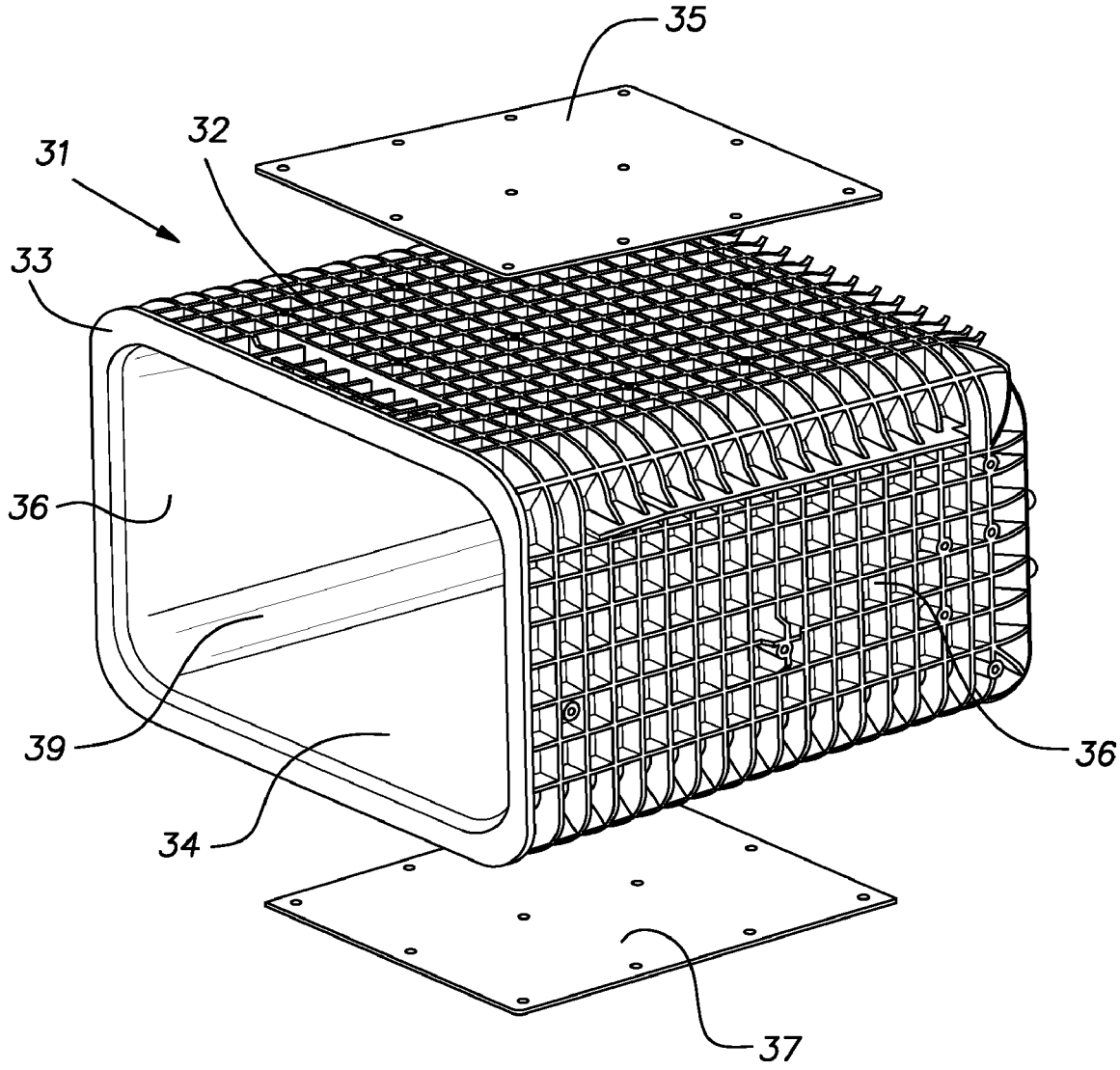
FIG. 11 is a perspective view of the external enclosure of the embodiment of the invention shown in FIG. 2 and including reinforcing plates applied to the top and bottom of the enclosure.

The external enclosure 31 includes an upper wall 32, a bottom wall 34, opposed side walls 36, only one of which can be seen in FIG. 2, and a rear wall 38. The external enclosure 31 also includes an opening 39 at the front of the enclosure by means of which access may be had to the interior of the enclosure. As shown in FIG. 11, a support plate 35 can be attached to the upper wall 32 and a support plate 37 can be attached to the bottom wall 34 to provide rigidity and strength to the external enclosure 31. The support plates 35 and 37 can be made of any suitable material such as stainless steel or a rigid plastic for example.

Figure 10:
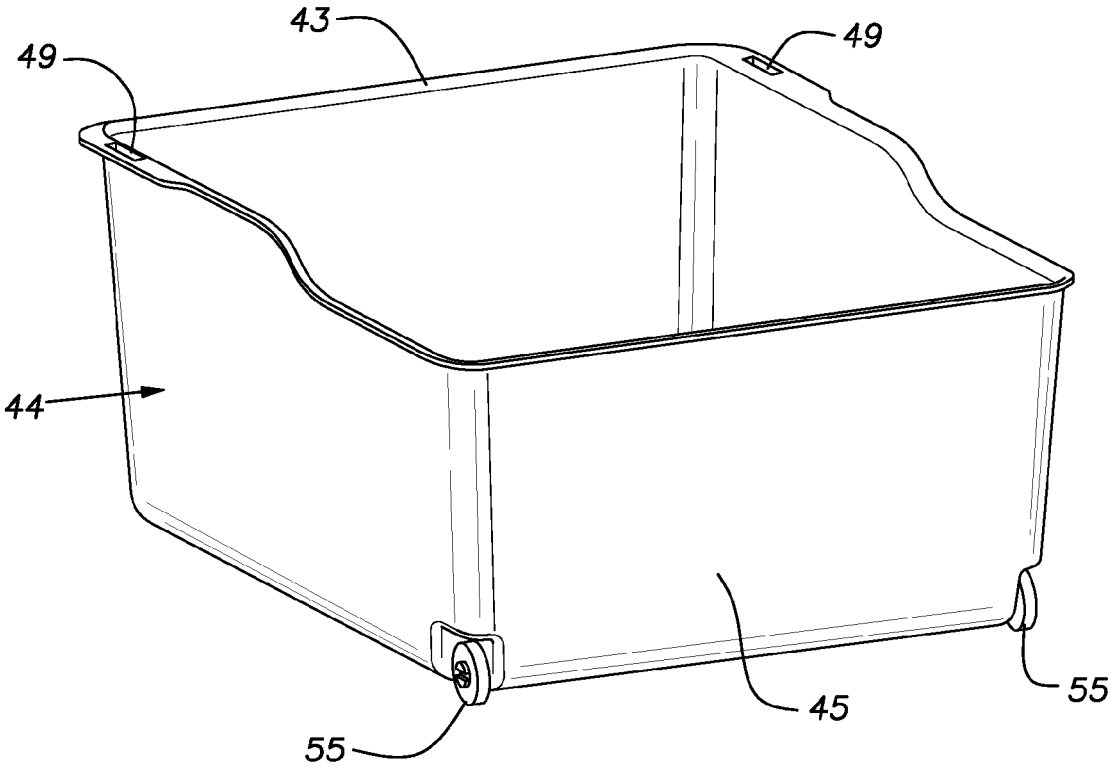
FIG. 10 is a perspective view of the pan that comprises a portion of the holding compartment of the embodiment of the storage compartment shown in FIG. 2.

The holding compartment 41 comprises a front panel 42 and a pan 44, shown in greater detail in FIG. 10, for holding articles placed within the holding compartment. The interior of the pan is adapted to be in air flow communication with the gas evacuation system. And a forward end 43 of the pan is supported at the front panel 42 while a rearward end 45 of the pan is supported at the interior of the external enclosure 31, more specifically at the interior surface of the bottom wall 34 of the external enclosure.

From the foregoing description, it will be understood that the holding compartment 41 is capable of being inserted into the interior of the external enclosure 31 through the opening 39 in the external enclosure, for storing articles contained within the holding compartment, and is capable of being withdrawn from the interior of the external enclosure 31 when access is to be had to the interior of the holding compartment. This movement of the holding compartment 41 into and out of the interior of the external enclosure 31 is accomplished by means of complementary surfaces at the holding compartment and at the exterior of the external enclosure that are in engagement with one another and along which the holding compartment travels when it is inserted into and withdrawn from the interior of the external enclosure 31. More specifically, with reference to FIG. 2, the complementary surfaces comprise a first component 50 of a sliding rail system that is mounted at the front panel 42 of the holding compartment 41 and a complementary second component 52 of the sliding rail system that is mounted at the exterior of the external enclosure 31. A sliding rail system as described is provided at both sides of the front panel 42 and both exterior sides of the external housing although only one is visible in FIG. 2. Sliding rail systems capable of functioning in the described manner are known to those having ordinary skill in the art. At the same time it will be understood that other types of arrangements can be provided for mounting the holding compartment in relation to the external enclosure in a way that will allow the holding compartment to be conveniently inserted into and withdrawn from the interior of the external enclosure.

Each of the external enclosure 31 and the holding compartment 41 have a coacting surface that comes closer to the other coacting surface as the holding compartment is inserted further into the interior of the external enclosure. A seal 60 is interposed between the coacting surfaces of the external enclosure 31 and the holding compartment 41 for sealing off the interior of the holding compartment to the entry of gases from outside the holding compartment when the holding compartment is inserted into the external enclosure and the coacting surfaces of the external enclosure and the holding compartment are brought together in a sealing relationship with the seal. These features of the external enclosure and the holding compartment are best seen with reference to FIGS. 2, 4 and 5 of the drawings.

It is first noted that the coacting surface 33 of the external enclosure is located at the front portion of the external enclosure at the perimeter of the opening 39 in the external enclosure as shown in FIG. 2. Referring to FIG. 4 in which the interior surface, or back, of the front panel 42 of the holding compartment is presented, the back of the front panel is shown as including the coacting surface 40 of the holding compartment 41. Threaded holes 75 also are provided at the back of the front panel 42 for securing a respective first component 50 of the sliding rail system at each side of the back of the front panel. A bracket 46 is mounted at the back of the front panel 42 using any suitable mounting means. In FIG. 4, openings 70 are provided in the bracket 46 and complementary threaded holes 71 are provided in the front panel whereby the bracket 46 can be mounted to the front panel using screws 73. The bracket 46 also includes a support system in the nature of support arms 47 for supporting the forward end 43 of the pan 44. In this connection, the slots 49 at the sides of and towards the front of the pan 44 fit down over the tabs 48 on the support arms 47 to hold the forward end 43 of the pan 44 in place on the bracket 46. The bottom of the rearward end 45 of the pan 44 includes a roller system in the form of two wheels 55 that rests at the interior surface of the bottom wall 34 of the external enclosure 31 and supports the rearward end of the pan. The bracket 46 also secures the seal, indicated generally at 60, in place at the coacting surface 40 of the front panel 42 so that the seal is mounted at the coacting surface 40 of the front panel 42 as best seen in FIG. 5.

Although the seal 60 is shown as mounted at the coacting surface 40 of the holding compartment 41, the seal can be mounted at either one of the coacting surface 40 of the holding compartment or the coacting surface 33 of the external enclosure 31. One way of mounting the seal 60 is best seen in FIG. 5. As shown there, the seal includes a projection 66 that fits into a slot at the coacting surface 40 and a flange 64 that is arranged at approximately a right angle to the projection 66. The bracket 46 bears against the flange 64 when the bracket 46 is secured to the back of the panel 42, and the seal 60 is thereby mounted at the coacting surface 40.

The seal 60, in addition to the flange 64 and the projection 66, includes a first portion 61 and a second portion 62. The first portion 61 and the second portion 62 of the seal 60 are arranged with respect to one another such that the first portion 61 of the seal will come into contact with the one of the coacting surfaces of the external enclosure 31 and the holding compartment 41 at which the seal is not mounted (coacting surface 33 in the embodiment illustrated in the drawings) before the second portion 62 of the seal comes into contact with the one of the coacting surfaces of the external enclosure and the holding compartment at which the seal is not mounted when the holding compartment 41 is inserted into the interior of the external enclosure 31 and the coacting surfaces 33 and 40 of the external enclosure and the holding compartment, respectively, are brought together in a sealing relationship with seal 60. The first portion 61 of the seal is more flexible than the second portion 62 of the seal and, as the coacting surfaces of the external enclosure 31 and the holding compartment 41 are brought together in a sealing relationship with the seal 60, the first portion 61 of the seal forms an initial flexible seal between the coacting surfaces of the external enclosure and the holding compartment. And the second portion of the seal 62, which is heavier and more substantial than the first portion 61 of the seal, forms a more substantial additional seal between the coacting surfaces of the external enclosure and holding compartment as the coacting surfaces of the external enclosure and the holding compartment surfaces are brought closer together as a result of the holding compartment being inserted further into the interior of the external enclosure. In the embodiment of the seal shown in FIG. 5, the first portion 61 of the seal 60 extends away from the coacting surface 40 toward the coacting surface 33 a further distance than the second portion 62 of the seal and, consequently, the first portion 61 of the seal 60 will engage the coacting surface 33 before the second portion 62 of the seal 60.

In the embodiment of the seal shown in the drawings, the first portion 61 of the seal 60 comprises a web that has an interior end attached at an attachment location 63 to the second portion 62 of the seal and a free end that extends away from the attachment location 63 and the coacting surface 40. The first portion 61 of the seal 60 is sufficiently flexible that the free end of the first portion of the seal will flex about the attachment location 63 where the interior end of the web is attached to the second portion of the seal and allow the coacting surface 33 of the external enclosure to come into contact with the second portion 62 of the seal when the coacting surfaces of the external enclosure and the holding compartment continue to be brought closer together as a result of the holding compartment 41 being inserted further into the interior of the external enclosure 31. Also in that embodiment, as shown in FIG. 5, the surface of the second portion 62 of the seal that comes into contact with the coacting surface 33 of the external enclosure 31 is convex. Further, as illustrated in that embodiment, the web 61 of the seal is flared in a direction outwardly of the attachment location 43 and forms an acute angle with the second portion 62 of the seal 60 at the attachment location 63, whereby the web engages the coacting surface 33 of the external enclosure 31 at an acute angle.

The application of the seal 60 is not limited to a storage compartment comprising an external enclosure and a holding compartment but the seal can also be utilized with other structures comprising a storage compartment. For example, the seal can be mounted at a coacting surface of a first component of a storage compartment and interposed between the coacting surface of the first component of the storage compartment and a coacting surface of a second component of the storage compartment, the first and second components of the storage compartment being movable with relation to one another such that their coacting surfaces are adapted to be moved together into a sealing relationship along with the seal, whereby gases may be evacuated from the first component of the storage compartment and the pressure in the first component of the storage compartment reduced. As described above, the seal would include a first portion and a second portion arranged with respect to one another such that the first portion of the seal would come into contact with the coacting surface of the second component of the storage compartment before the second portion of the seal comes into contact with the coacting surface of the second component of the storage compartment when the first component and the second component are brought together in a sealing relationship with the seal. The first portion of the seal would be more flexible than the second portion of the seal, whereby, as the coacting surfaces of the first component and the second component of the storage compartment are brought together in a sealing relationship with the seal, the first portion of the seal would form an initial seal between the coacting surfaces of the first component and the second component and the second portion of the seal would form a more substantial additional seal between the coacting surfaces of the first component and the second component as the coacting surfaces of the first component and the second component of the storage compartment are brought closer together.

Also as described with reference to the holding compartment 41 and the external enclosure 31, the first portion of the seal would comprise a web that has an interior end attached at an attachment location to the second portion of the seal and a free end that extends away from the attachment location and the coacting surface of the first component of the storage compartment at which the seal is mounted. The web would be sufficiently flexible that the free end of the web would flex about the attachment location where the interior end of the web is attached to the second portion of the seal and allow the coacting surface of the second component of the storage compartment to come into contact with the second portion of the seal when the coacting surfaces of the first component and the second component of the storage compartment are brought closer together. The surface of the second portion of the seal that comes into contact with the coacting surface of the second component of the storage compartment would be convex in one embodiment.

Figure 6:
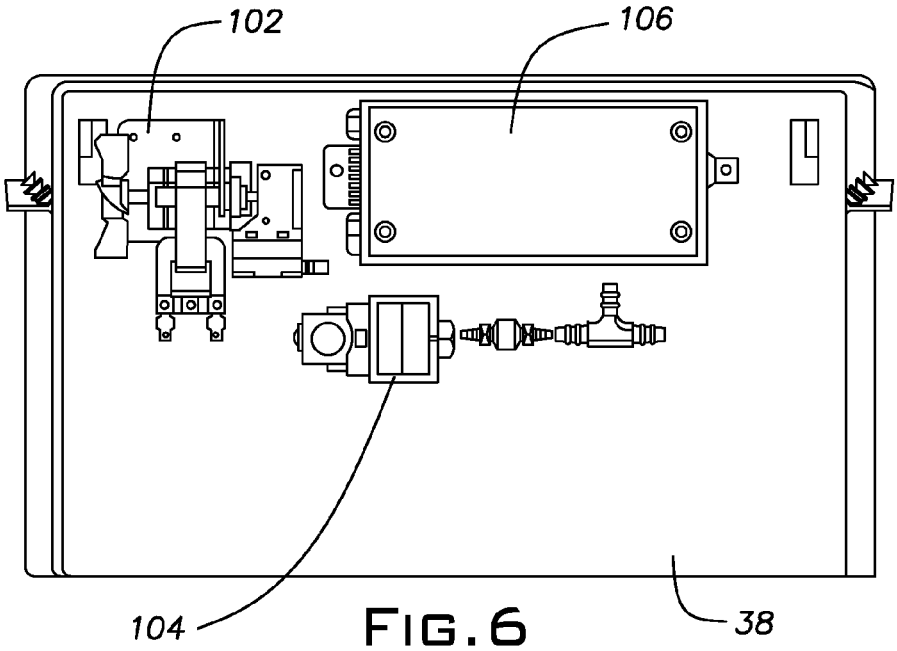
FIG. 6 is a rear elevational view of the storage compartment of FIG. 2 that shows certain auxiliary equipment installed at the rear wall of the external enclosure of the storage compartment.

As noted above, the interior of the storage compartment 30, including the interior of the holding compartment 41, is adapted to be in gas flow communication with a gas evacuation system for removing gases from the interior of the storage compartment, including the interior of the holding compartment. Such a gas evacuation system is shown in FIG. 6 at 102 as being mounted at the rear surface 38 of the external enclosure 31. The gas evacuation system can comprise what is typically referred to as a vacuum pump. The gas evacuation system 102, in addition to being in gas flow communication with the interior of the storage compartment 30, is capable of functioning selectively in an active state wherein the gas evacuation system removes gases from the interior of the storage compartment 30, including the holding compartment 41, and in an idle state wherein the gas evacuation system 102 does not remove gases from the interior of the storage compartment including the holding compartment.

Also in gas flow communication with the interior of the storage compartment 30, including the holding compartment 41, is a valve arrangement 104 that also is mounted at the rear wall 38 of the external housing 31. The valve arrangement 104 can comprise any type of valve known to those of ordinary skill in the art that is capable of functioning in an open state wherein gases from outside the interior of the storage compartment 30 can be admitted through the valve arrangement to the interior of the storage compartment and a closed state wherein gases from outside the interior of the storage compartment 30 are prevented from being admitted to the interior of the storage compartment through the valve arrangement. For example, the valve arrangement 104 can comprise a solenoid operated valve in the nature of a pressure release valve.

In one aspect, the storage compartment 30 can function so that the gas evacuation system 102 can be selectively placed in an active state and the valve arrangement 104 selectively placed in a closed state, whereby gases will be removed from the interior of the storage compartment 30 and the pressure within the interior of the holding compartment 41 reduced to a selected pressure less than the pressure outside the interior of the storage compartment when the interior of the storage compartment is otherwise sealed off from the admittance of gases from outside the storage compartment. When the storage compartment 30 functions in this manner, the articles stored in the holding compartment 41 will be stored under vacuum wherein less oxygen will be available to react with the stored articles.

The gas evacuation system 102, additionally, can be selectively placed in an idle state and the valve arrangement 104 can be selectively, concurrently placed in an open state when the interior of the storage compartment 30 is at a pressure below the pressure outside the interior of the storage compartment as described in the preceding paragraph. In that case, the gases admitted to the interior of the holding compartment 41 through the valve arrangement 104 will cause the pressure within the interior of the storage compartment to increase so that the pressure within the interior of the storage compartment and the pressure outside the interior of the storage compartment will be substantially equalized. This makes it more convenient to access the articles within the holding compartment.

In another aspect, the gas evacuation system 102 can be selectively placed in an intermittent active state following the reduction of the pressure in the holding compartment 41 to a selected pressure as described above and the valve arrangement 104 placed in a closed state. In this case, additional gases are intermittently removed from the interior of the holding compartment 41 and the pressure within the interior of the holding compartment is maintained below the pressure at the outside of the storage compartment and the conditions of a vacuum preserved. Such additional gases can be generated, for example, by the articles, such as foodstuffs, stored within the holding compartment. In a particular instance, the additional gases can comprise ethylene gas given off by fruits and vegetables stored in the holding compartment 41.

In addition to functioning as a vacuum compartment as described in the several immediately preceding paragraphs, the storage compartment 30 can function as a crisper for fruits and vegetables for example. In that case, the gas evacuation system 102 is selectively placed in an active state and the valve arrangement 104 placed in an open state, whereby the gases admitted to the interior of the holding compartment 41 through the valve arrangement 104 are ventilated through the interior of the storage compartment. The ventilation can provide a variety of salutary effects. For example, humidity can build up in the storage compartment 30 and the excess humidity can be removed by the gas evacuation system 102 while fresh air is admitted to the storage compartment through the valve arrangement 104.

When a gas evacuation system is provided, an electronic-control system, including a controller 106, can be provided for controlling the operations of the gas evacuation system 102 and the valve arrangement 104, as those operations have been described above. Any suitable type of controller known in the art may be used. The controller 106 can also be located at the rear wall 38 of the external enclosure 31 as shown in FIG. 6. A user interface 57 located at the top wall 32 of the external enclosure 31 near the front of the enclosure, as shown in FIG. 2, is operatively connected to the controller 106 for providing to the controller instructions concerning the operation of the gas evacuation system 102 and the valve arrangement 104 as input to the user interface 57 by a user. The user can employ the user interface 57 to switch between the modes of operation of the storage compartment described above by entering an appropriate command into the user interface. More specifically, when the user enters a command into the user interface 57, such as, for example, when the user wishes to store articles in the storage compartment under vacuum, the command is communicated to the controller 106. The controller 106 then processes the command and sends a corresponding signal to the gas evacuation system 102 and the valve arrangement 104. The gas evacuation system and the valve arrangement then function in the mode selected by the user. If the user selects the vacuum mode and subsequently wishes to access the stored articles, the user enters an appropriate command at the user interface 57 and the controller, in response, will cause the gas evacuation system to be placed in an idle mode and cause the valve arrangement to be opened whereby the pressure within the storage compartment and pressure outside the compartment will be equalized.

The controller 106 also can be programmed so as to control the functioning of the gas evacuation system and valve arrangement for the purpose of intermittently removing additional gases from the interior of the storage compartment 30 after the compartment has been placed in the vacuum mode. The user interface 57 also provides for selectively inputting instructions to the controller 106 for placing each of the gas evacuation system 102 and the valve arrangement 104 in a non-functioning mode whereby the gas evacuation system and the valve arrangement are shut down. The controller 106, as well as some or all of the other components shown as mounted to rear wall 38 of the external enclosure 31, can be located elsewhere inside or outside the refrigerator 10.

Although not required, the operation of the storage compartment 30 can be supplemented by the inclusion of a latching mechanism for securing the holding compartment 41 to the external enclosure 31 when the coacting surfaces of the holding compartment and the external enclosure are brought together. An embodiment of such a latching mechanism is shown in the drawings in FIGS. 2, 3, 7, 8 and 9.

The function of the latching mechanism is to secure the holding compartment 41 to the external enclosure 31 so as to initially maintain in place the seal 60 sealing off the interior of the holding compartment from the exterior of the external housing. Thus, the latching mechanism provides the initial force required to seal the holding compartment 41 and the external enclosure 31 together whereby gases are prevented from entering the holding compartment interior. As a result, when the gas evacuation system 102 is in an active state and the valve arrangement 104 is in a closed state, the pressure within the interior of the holding compartment 41 can be reduced to a selected pressure less than the pressure at the exterior of the external enclosure 31. The latching mechanism also can function in a manner so as to be inoperative to secure the holding compartment 41 to the external enclosure 31 when the pressure differential between the pressure within the interior of the holding compartment and the pressure at the exterior of the external enclosure is adequate to prevent the holding compartment from becoming disengaged from the external enclosure so as to prevent opening of the seal between the holding compartment 41 and the external enclosure 31. As a result, when one wishes to access the interior of the holding compartment 41 and the interior of the holding compartment is at a reduced pressure, it is only necessary to allow gas to enter the holding compartment through the valve arrangement 104 so as to equalize the pressure within the holding compartment and the pressure at the exterior of the external enclosure. And it is not necessary to wait for the latching mechanism to first be freed.

As noted, the latching mechanism is provided for securing the holding compartment 41 and the external enclosure 31 together when the coacting surfaces 40 and 33 of the holding compartment and the external enclosure, respectively, are first brought together. As a result, the coacting surfaces along with the seal 60 positioned between the coacting surfaces, all come into tight engagement, whereby the coacting surfaces of the holding compartment and the external enclosure are prevented from disengaging and allowing gases from outside the interior of the holding compartment to enter the interior of the holding compartment. The latching mechanism functions so as to be disabled from securing the holding compartment 41 and the external enclosure 31 together when the gas evacuation system 102 has removed sufficient gas from the interior portion of the holding compartment to establish a pressure differential between the interior portion of the holding compartment and the exterior of the external enclosure adequate to maintain the drawer and the external enclosure secured together In the embodiment shown in the accompanying drawings, the latching mechanism for securing together the external housing 31 and the holding compartment 41 when the coacting surfaces 40 and 33 of the holding compartment and the external housing, respectively, are brought together in a sealing relationship with the seal 60 comprises a fixed retaining element 82 mounted at one of the external enclosure and the holding compartment and a movable latching element 80 mounted at the other one of the external enclosure and the holding compartment. The movable latching element 80 is movable between a position where it is free of the fixed retaining element 82 and a position where it is latched to the fixed retaining element. In the embodiment shown in the drawings, the fixed retaining element 82 is mounted at the holding compartment 41 and the movable latching element 80 is mounted at the external enclosure 31. More specifically, in that embodiment, the fixed retaining element 82 is mounted at the first component 50 of the sliding rail system and the movable latching component 80 is mounted at the second component 52 of the sliding rail system.

Figure 7:
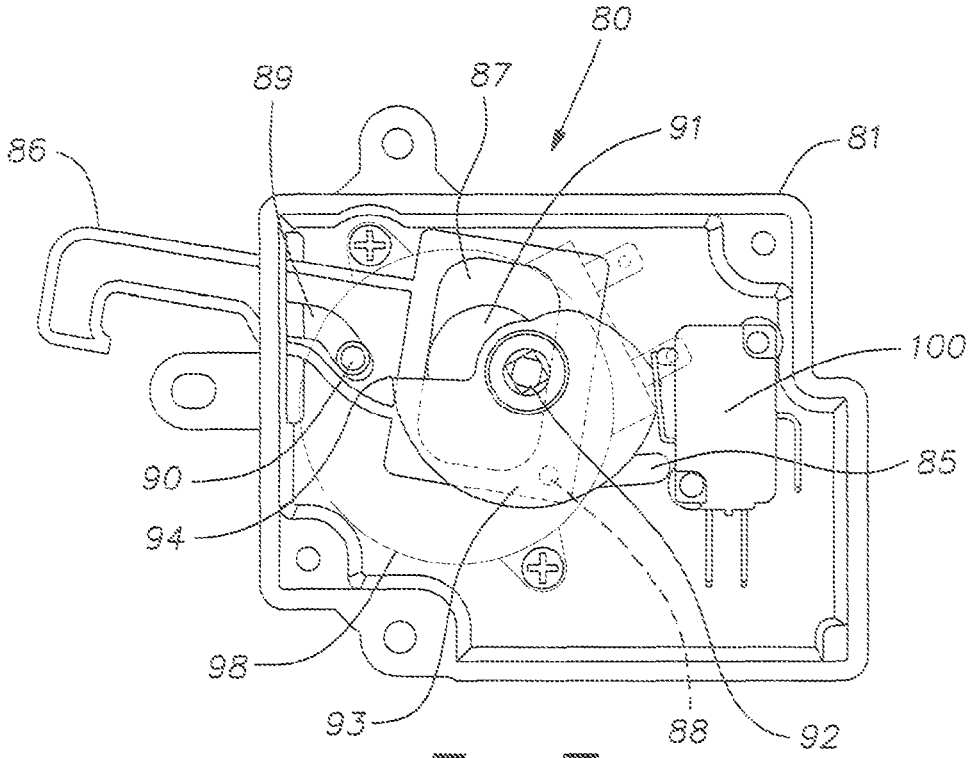
FIG. 7 is a front elevational view of an embodiment of the movable latching element of the latching mechanism of FIG. 3 shown with the front cover of the movable latching element housing removed to show the arrangement of certain details of the movable latching element when the movable latching element is free of the fixed retaining element.
Figure 8:
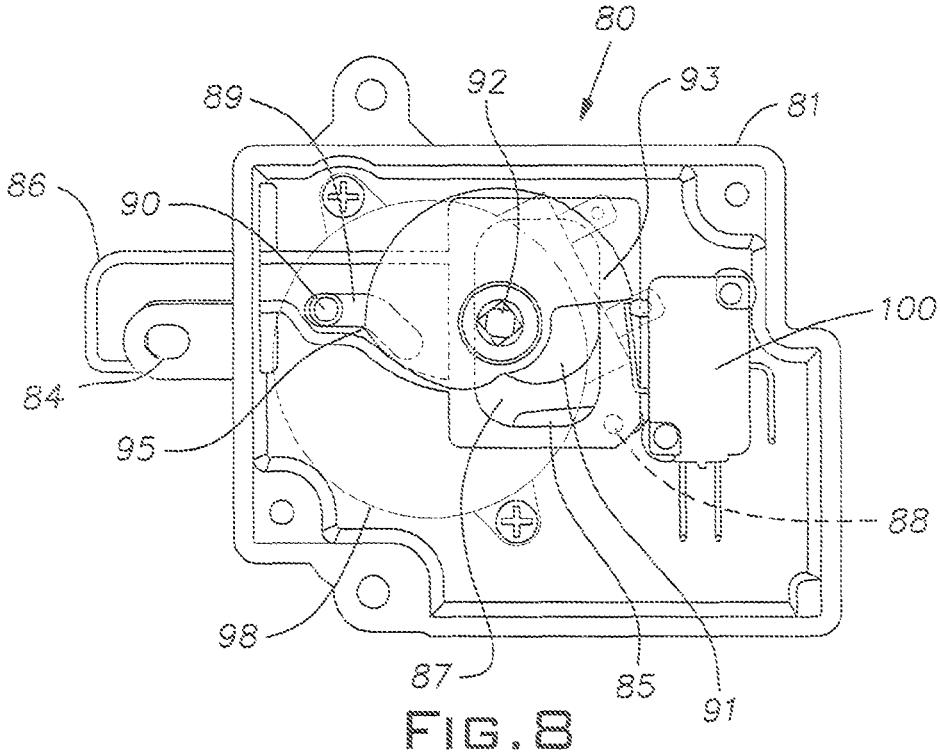
FIG. 8 is a front elevational view of the embodiment of the movable latching element of the latching mechanism shown in FIG. 7 shown with the front cover of the movable latching element housing removed to show the arrangement of certain details of the movable latching element when the movable latching element is latched to the fixed retaining element.
Figure 9:
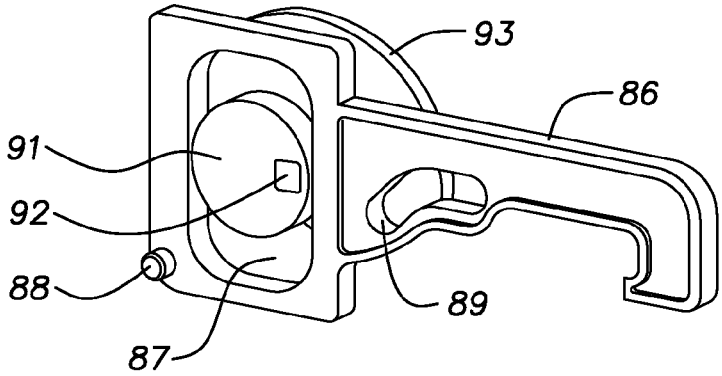
FIG. 9 is a perspective view of the hook-shaped element and cam that are included in the movable latching element shown FIGS. 7 and 8.

The movable latching element comprises a hook-shaped element 86 in which is located an opening 87 as best seen in FIG. 9. The hook-shaped element 86 is movable between a position where the hook-shaped element is free of the fixed retaining element 82 as shown in FIG. 7 and a position where the hook-shaped element 86 is latched to the fixed retaining element 82 as shown in FIG. 8. When the hook-shaped element 86 is latched to the fixed retaining element 82, the hooked portion of the hook-shaped element will be latched down over the dowel 84 of the fixed retaining element 82.

The movable latching element 80 also includes a driving arrangement that is operatively associated with the hook-shaped element 86 for moving the hook-shaped element between the position where the hook-shaped element is free of the fixed retaining element 82 and the position where the hook-shaped element is latched to the fixed retaining element. The hook-shaped element 86 and the driving arrangement for the hook-shaped element are contained within housing 81 of the movable latching mechanism 80. The driving arrangement includes a motor 98 that is mounted to the inside of the housing 81 and is behind the hook-shaped element 86 as viewed in FIGS. 7 and 8. The motor has a drive shaft that is attached to a cam 91 by insertion of the drive shaft into the opening 92 in the cam. The opening 92 is offset from the center of the cam 91, which is cylindrical in shape, whereby the cam will rotate in an eccentric manner when driven by drive shaft of the motor. The cam 91 is located in the opening 87 in the hook-shaped element 86 and as the drive shaft rotates the cam eccentrically within the opening 87, the hook-shaped element 86 will be caused to move between the position where the hook-shaped element is free of the fixed retaining element 82 and the position where the hook-shaped element is latched to the fixed retaining element.

The movement of the hook-shaped element between the free and latched positions is abetted by a fixed pin 90 attached to the housing 81 and located in a guide slot 89 in the hook-shaped element 86 together with a pin 88 attached to the hook-shaped element 86 and located in a slot 85 in the housing 81. More specifically, when the hook-shaped element moves between the free position of FIG. 7 and the latched position of FIG. 8, the eccentric rotation of the cam 91 in the opening 87 will force the hook-shaped element rearward or to the right as viewed in FIG. 7. The concurrent movement of the pin 88 in the slot 85 will allow this rearward movement of the hook-shaped element to take place. At the same time, the fixed pin 90 will move in the guide slot 89. The guide slot has a configuration such that the fixed pin 90 and the guide slot cooperatively cause the hook-shaped element 86 to move between the position where the hook-shaped element is free of the fixed retaining element, as shown in FIG. 7 and the position where the hook-shaped element is latched to the dowel 84 of the fixed retaining element 82, as shown in FIG. 8. When the hook-shaped element is to be freed from the dowel 84, the motor 98 rotates the drive shaft in the opposite direction, causing the cam 91 to be rotated in the opposite direction and forcing the hook-shaped element forward or to the left as viewed in FIG. 8. Once again the movement of the pin 88 in the slot 85 will allow for the forward movement of the hook-shaped element. At the same time the interaction between the pin 90 and the guide slot 89 will cause the hook-shaped element to move to the position shown in FIG. 7 and become unlatched from the dowel 84.

A flange 93 is attached to the cam 91 so as to rotate with the cam, the flange having two contact points 94 and 95. Contact point 95 is adapted to contact a control switch 100 when the hook-shaped element 86 is in the position free of the fixed retaining element and the other contact point 94 is adapted to contact the control switch when the hook-shaped element is latched to the fixed retaining element. The control switch controls the operation of the motor 98.

The interaction between the latching mechanism and the controller 106 is as follows. When the holding compartment 41 is contained within the external enclosure 31, and the coacting surfaces of the holding compartment and the external enclosure, 40 and 33, respectively, are brought together, and a user initiates the vacuum mode through the user interface 57, the controller 106 activates the latching mechanism by supplying power to the motor 98 whereupon the motor drive shaft is rotated so as to rotate the cam 91 in the opening 87 of the hook-shaped element 86. Initially at this point, the hook-shaped element 86 is in the attitude shown in FIG. 7 and as the cam 91 rotates, it forces the hook-shaped element to move in a direction away from the fixed latching element 82 and finally assume the rearward position shown in FIG. 8. At the same time as this movement is occurring, the hook-shaped element 86 guided by the interaction of the pin 90 and the guide slot 89 will move from the upward attitude shown in FIG. 7 to the final position shown in FIG. 8. The combination of these two movements of the hook-shaped element 86 backward and downward results in the hook-shaped element 86 latching on to the dowel 84 and pulling the holding compartment 41 and the external enclosure 31 into tight engagement.

When the hook-shaped element 86 is in the position shown in FIG. 8, the flange 93 that is attached to the cam 91 will have rotated with the cam and will have reached a position where its contact point 94 will have activated control switch 100 thereby shutting off power to the motor 98. At the same time, the controller 106 is informed by the control switch 100 that the holding compartment 41 is secured to the external enclosure 31 and the controller will cause the gas evacuation system 102 to be activated so that gases can be removed from the interior of the holding compartment 41. The latching mechanism continues to secure the holding compartment to the external enclosure 31 until the pressure in the drawer holding compartment reaches a pre-selected level that is adequate for the resulting pressure differential between the pressure within the holding compartment 41 and the pressure at the exterior of the external enclosure 31 to maintain the holding compartment secure to the external enclosure. When the pre-selected pressure level is reached, as sensed by a pressure sensor for example located within the holding compartment 41, the information is passed on to the controller 106. The controller then activates the motor 98 so as to rotate the motor drive shaft in the opposite direction. At this point, the cam 91 forces the hook-shaped element 86 forward while at the same time the cooperative functioning of the fixed pin 90 and the guide slot 89 moves the hook-shaped element upwardly. As a result, the hook-shaped element moves from the position shown in FIG. 8 to the position shown in FIG. 7, whereby the latching mechanism becomes separated, that is, the hook-shaped element 86 becomes disengaged from the dowel 84. When the hook-shaped latching element has reached the position shown in FIG. 7, the opposite contact point 95 on the flange 93 will engage the power switch 100 causing the switch to turn off the motor. Disengaging the latching mechanism in this way allows the user to more quickly access the contents of the holding compartment at a later time as desired. Access can be gained to the interior of the holding compartment by the user simply inputting to the user interface 57 directions to allow the valve arrangement 104 to admit gases into the holding compartment interior and equalize the pressure in the holding compartment and the pressure at the outside of the external enclosure. It is not necessary at that time to also disengage the latching mechanism.

The application of the latching mechanism is not limited to a storage compartment comprising an external enclosure and a holding compartment as described above, but the latching mechanism can also be utilized with other structures comprising a storage compartment. For example, the seal can be used to secure a first component and a second component of a storage compartment together, the first component and second component being movable relative to one another. 29. In that case, the latching mechanism would comprise a fixed retaining element mounted at one of the first component and the second component and a movable latching element mounted at the other one of the first component and the second component. The movable latching element would comprise a hook-shaped element in which is located an opening, and the hook-shaped element would be movable between a position where the hook-shaped element is free of the fixed retaining element and a position where the hook-shaped element is latched to the fixed retaining element. A driving arrangement would be operatively associated with the hook-shaped element for moving the hook-shaped element between a position where the hook-shaped element is free of the fixed retaining element and a position where the hook-shaped element is latched to the fixed retaining element. The driving arrangement would include a motor with a drive shaft attached to a cam located in the opening in the hook-shaped element so as to rotate the cam within the opening in the hook-shaped element and cause the hook-shaped element to move between the position where hook-shaped element is free of the fixed retaining element and the position where the hook-shaped element is latched to the fixed retaining element. In one embodiment, the latching mechanism would include a fixed pin located in a guide slot in the hook-shaped element, the guide slot having a configuration such that the fixed pin and the guide slot cooperatively assist in causing the hook-shaped element to move between the position where it is free of the fixed retaining element and the position where it is latched to the fixed retaining element. In another embodiment, a flange could be attached to the cam so as to rotate with the cam, the flange having two contact points, one contact point adapted to contact a control switch when the hook-shaped element is in the position free of the fixed retaining element and the other contact point adapted to contact the control switch when the hook-shaped element is latched to the fixed retaining element.

What is claimed is:

1. A storage compartment comprising:

an external enclosure having an opening by means of which access may be had to the interior of the enclosure;

a holding compartment capable of being inserted into the interior of the external enclosure through the opening in the external enclosure, for storing articles contained within the holding compartment, and capable of being withdrawn from the interior of the external enclosure, when access is to be had to the interior of the holding compartment, each of the external enclosure and the holding compartment having a coacting surface that comes closer to the other coacting surface as the holding compartment is inserted further into the interior of the external enclosure, and the holding compartment being adapted to be in gas flow communication with a gas evacuation system for removing gases from the interior of the holding compartment;

a seal interposed between the coacting surfaces of the external enclosure and the holding compartment for sealing off the interior of the holding compartment to the entry of gases from outside the holding compartment when the holding compartment is inserted into the external enclosure and the coacting surfaces of the external enclosure and the holding compartment are brought together in a sealing relationship with the seal wherein a bracket secures the seal in place between the coacting surfaces of the external enclosure and the holding compartment and includes a support system for supporting a pan for holding the articles placed within the holding compartment; and complementary surfaces at the holding compartment and at the exterior of the external enclosure that are in engagement with one another and along which the holding compartment travels when it is inserted into and when it is withdrawn from the interior of the external enclosure, wherein the seal includes a first portion and a second portion, wherein the first portion of the seal comprises a web that has an interior end attached at an attachment location to the second portion of the seal and a free end that extends away from the attachment location and the second portion, whereby, the first portion and second portion of the seal directly contact the coacting surface of the holding compartment as the coacting surfaces of the external enclosure and the holding compartment are brought closer together.

2. The storage compartment of claim 1 wherein the storage compartment is adapted to be contained within a refrigerator.

3. The storage compartment of claim 1 including a latching mechanism for securing together the external housing and the holding compartment when the holding compartment is inserted into the external housing and the coacting surfaces of the holding compartment and the external housing are brought together in a sealing relationship with the seal.

4. The storage compartment of claim 3 wherein the latching mechanism comprises:

a fixed retaining element mounted at one of the external housing and the holding compartment; and a movable latching element mounted at the other one of the external housing and the holding compartment, the movable latching element being movable between a position where it is free of the fixed retaining element and a position where it is latched to the fixed retaining element.

5. The storage system of claim 4 wherein the complementary surfaces at the holding compartment and at the exterior of the external enclosure that are in engagement with one another and along which the holding compartment travels when it is inserted into and withdrawn from the external enclosure comprise a first component of a sliding rail system mounted at the holding compartment and a complementary second component of the sliding rail system mounted at the exterior of the external enclosure.

6. The storage compartment of claim 5 wherein the fixed retaining element is mounted at the first component of the sliding rail system and the movable latching component is mounted at the second component of the sliding rail system.

7. The storage compartment of claim 6 wherein the storage compartment is adapted to be contained within a refrigerator.

8. The storage compartment of claim 4 wherein the movable latching element comprises:

a hook-shaped element in which is located an opening, the hook-shaped element being movable between a position where the hook-shaped element is free of the fixed retaining element and a position where the hook-shaped element is latched to the fixed retaining element;

and a driving arrangement that is operatively associated with the hook-shaped element for moving the hook-shaped element between the position where the hook-shaped element is free of the fixed retaining element and the position where the hook-shaped element is latched to the fixed retaining element, the driving arrangement including a motor with a drive shaft attached to a cam located in the opening in the hook-shaped element so as to rotate the cam within the opening in the hook-shaped element and cause the hook-shaped element to move between the position where the hook-shaped element is free of the fixed retaining element and the position where the hook-shaped element is latched to the fixed retaining element.

9. The storage compartment of claim 8 including a fixed pin located in a guide slot in the hook-shaped element, the guide slot having a configuration such that the fixed pin and the guide slot cooperatively cause the hook-shaped element to move between the position where the hook-shaped element is free of the fixed retaining element and the position where the hook-shaped element is latched to the fixed retaining element.

10. The storage compartment of claim 9 wherein a flange is attached to the cam so as to rotate with the cam, the flange having two contact points, one contact point adapted to contact a control switch when the hook-shaped element is in the position free of the fixed retaining element and the other contact point adapted to contact the control switch when the hook-shaped element is latched to the fixed retaining element.

11. The storage compartment of claim 10 wherein the storage compartment is adapted to be contained within a refrigerator.

12. The storage compartment of claim 1 wherein the holding compartment comprises:

a front panel that includes the coacting surface of the holding compartment; wherein the interior of the pan being adapted to be in air flow communication with the gas evacuation system, a forward end of the pan being supported at the front panel and a rearward end of the pan being supported at the interior of the external enclosure.

13. The storage compartment of claim 12 wherein the seal is mounted at the coacting surface of the front panel.

14. The storage compartment of claim 13 wherein the bracket secures the seal in place at the coacting surface of the front panel wherein the support system supports the forward end of the pan.

15. The storage compartment of claim 14 wherein the bottom of the rearward end of the pan includes a roller system that rests on the interior surface of a bottom wall of the external enclosure and supports the rearward end of the pan.

16. The storage compartment of claim 15 wherein the complementary surfaces at the holding compartment and at the external enclosure that are in engagement with one another and along which the holding compartment travels when it is inserted into and withdrawn from the external enclosure comprise a first component of a sliding rail system mounted at the front panel and a complementary second component of the sliding rail system mounted at the external enclosure.

17. The storage compartment of claim 16 wherein the first portion and the second portion of the seal being arranged with respect to one another such that the first portion of the seal comes into contact with the coacting surface of the external enclosure before the second portion of the seal comes into contact with the coacting surface of the external enclosure when the holding compartment is inserted into the interior of the external enclosure and the coacting surfaces of the external enclosure and the holding compartment are brought together in a sealing relationship with the seal, the first portion of the seal being more flexible than the second portion of the seal, whereby, as the coacting surfaces of the external enclosure and the holding compartment are brought together in a sealing relationship with the seal, the first portion of the seal forms an initial seal between the coacting surfaces of the external enclosure and the holding compartment and the second portion of the seal forms a more substantial additional seal between the coacting surfaces of the external enclosure and the holding compartment as the coacting surfaces of the external enclosure and the holding compartment are brought closer together.

18. The storage compartment of claim 17 wherein the first portion of the seal comprises a web that has an interior end attached at an attachment location to the second portion of the seal and a free end that extends away from the attachment location and the coacting surface of the holding compartment at which the seal is mounted, the web being sufficiently flexible that the free end of the web will flex about the attachment location where the interior end of the web is attached to the second portion of the seal and allow the coacting surface of the external enclosure to come into contact with the second portion of the seal as the coacting surfaces of the external enclosure and the holding compartment are brought closer together.

19. The storage compartment of claim 18 wherein the surface of the second portion of the seal that comes into contact with the coacting surface of the external enclosure is convex.

20. The storage compartment of claim 19 wherein the web is flared outwardly of the attachment location and forms an acute angle with the second portion of the seal whereby the web engages the coacting surface of the external enclosure at an acute angle.

21. The storage compartment of claim 20 wherein the storage compartment is adapted to be contained within a refrigerator.

22. The storage compartment of claim 1 wherein the seal is mounted at one of the coacting surface of the holding compartment and the coacting surface of the external enclosure and includes a first portion and a second portion, the first portion and the second portion of the seal being arranged with respect to one another such that the first portion of the seal comes into contact with the one of the coacting surfaces of the external enclosure and the holding compartment at which the seal is not mounted before the second portion of the seal comes into contact with the one of the coacting surfaces of the external enclosure and the holding compound at which the seal is not mounted when the holding compartment is inserted into the interior of the external enclosure and the coacting surfaces of the external enclosure and the holding compartment are brought together in a sealing relationship with the seal, the first portion of the seal being more flexible than the second portion of the seal, whereby, as the coacting surfaces of the external enclosure and the holding compartment are brought together in a sealing relationship with the seal, the first portion of the seal forms an initial seal between the coacting surfaces of the external enclosure and the holding compartment and the second portion of the seal forms a more substantial additional seal between the coacting surfaces of the external enclosure and holding compartment as the coacting surfaces of the external enclosure and the holding compartment surfaces are brought closer together.

23. The storage compartment of claim 22 wherein the first portion of the seal comprises a web that has an interior end attached at an attachment location to the second portion of the seal and a free end that extends away from the attachment location and the coacting surface of the one of the external enclosure and the holding compartment at which the seal is mounted, the web being sufficiently flexible that the free end of the web will flex about the attachment location where the interior end of the web is attached to the second portion of the seal and allow the coacting surface of the one of the external enclosure and holding compartment at which the seal is not mounted to come into contact with the second portion of the seal as the coacting surfaces of the external enclosure and the holding compartment are brought closer together.

24. The storage compartment of claim 23 wherein the surface of the second portion of the seal that comes into contact with the coacting surface of the one of the holding compartment and external enclosure at which the seal is not mounted is convex.

25. The storage compartment of claim 24 wherein the storage compartment is adapted to be contained within a refrigerator.

26. The storage compartment of claim 1 wherein the external enclosure includes an upper wall and a bottom wall and a respective support plate is attached to each of the upper wall and the bottom wall.

27. A seal mounted at a coacting surface of a first component of a storage compartment and interposed between the coacting surface of the first component of the storage compartment and a coacting surface of a second component of the storage compartment, the seal comprising:

a first portion and a second portion, the first portion and the second portion of the seal being arranged with respect to one another such that the first portion of the seal comes into contact with the coacting surface of the second component of the storage compartment before the second portion of the seal comes into contact with the coacting surface of the second component of the storage compartment when the first component and the second component are brought together in a sealing relationship with the seal; and the first portion of the seal being a single layer and more flexible than the second portion of the seal, whereby, as the coacting surfaces of the first component and the second component of the storage compartment are brought together in a sealing relationship with the seal, the first portion of the seal forms an initial seal between the coacting surfaces of the first component and the second component and the second portion of the seal directly contacts the coacting surface of the second component to form a more substantial additional seal between the coacting surfaces of the first component and the second component as the coacting surfaces of the first component and the second component of the storage compartment are brought closer together;

wherein the second portion of the seal is in a direct sealing relationship with the coacting surface of the second component when the first component and the second component are brought together in a sealing relationship with the seal, and further wherein the first portion of the seal extends away from the coacting surface of the first component a further distance than the second portion of the seal, further wherein a bracket secures a flange of the seal in place between the coacting surfaces of the first component and the second component of the storage compartment, the flange projecting from a first side of the second portion of the seal and the first portion of the seal being positioned on a second side of the second portion of the seal that is opposite from the flange.

28. The seal of claim 27 wherein the first portion of the seal comprises a web that has an interior end attached at an attachment location to the second portion of the seal and a free end that extends away from the attachment location and the coacting surface of the first component of the storage compartment at which the seal is mounted, the web being sufficiently flexible that the free end of the web will flex about the attachment location where the interior end of the web is attached to the second portion of the seal and allow the coacting surface of the second component of the storage compartment to come into contact with the second portion of the seal when the coacting surfaces of the first component and the second component of the storage compartment are brought closer together.

29. The seal of claim 28 wherein the surface of the second portion of the seal that comes into contact with the coacting surface of the second component of the storage compartment is convex.

30. The seal of claim 28 wherein the flange of the seal is secured between the bracket on one side and the coacting surface of the first component on a second side that is opposite from the first side.

31. The seal of claim 28 wherein the seal further includes a projection configured to fit into a slot at the coacting surface of the first component, further wherein the projection is in contact with and extends from a third side of the second portion of the seal, the third side being between the first side and the second side.

32. The seal of claim 31, wherein the flange does not contact the projection or the first portion of the seal.

* * * * *